US006805759B2

(12) United States Patent
Hoffmann et al.

(10) Patent No.: US 6,805,759 B2
(45) Date of Patent: Oct. 19, 2004

(54) SHAPED PART MADE OF AN INTERMETALLIC GAMMA TITANIUM ALUMINIDE MATERIAL, AND PRODUCTION METHOD

(75) Inventors: Andreas Hoffmann, Breitenwang-Mühl (AT); Heinrich Kestler, Reutte (AT)

(73) Assignee: Plansee Aktiengesellschaft, Reutte/Tirol (AT)

( * ) Notice: Subject to any disclaimer, the term of this patent is extended or adjusted under 35 U.S.C. 154(b) by 0 days.

(21) Appl. No.: 10/704,258

(22) Filed: Nov. 7, 2003

(65) Prior Publication Data

US 2004/0094242 A1 May 20, 2004

Related U.S. Application Data

(63) Continuation of application No. PCT/AT02/00205, filed on Jul. 12, 2002.

(30) Foreign Application Priority Data

Jul. 19, 2001 (AT) ..... GM573/2001

(51) Int. Cl.[7] ..... C22C 14/00; C22F 1/18

(52) U.S. Cl. ..... 148/669; 148/670; 148/421; 420/418; 420/590; 428/546; 428/651; 428/660

(58) Field of Search ..... 148/669, 670, 148/688, 421; 420/418, 590; 428/546, 651, 660

(56) References Cited

U.S. PATENT DOCUMENTS

| | | | | |
|---|---|---|---|---|
| 4,917,858 A | | 4/1990 | Eylon et al. | |
| 5,015,534 A | | 5/1991 | Kampe et al. | |
| 5,204,058 A | | 4/1993 | Huang | |
| 5,226,985 A | | 7/1993 | Kim et al. | |
| 5,358,687 A | | 10/1994 | Ichikawa et al. | |
| 5,424,027 A | | 6/1995 | Eylon | |
| 5,429,796 A | | 7/1995 | Larsen, Jr. | |
| 5,514,333 A | | 5/1996 | Fujiwara et al. | |
| 5,580,665 A | | 12/1996 | Taguchi et al. | |
| 5,609,698 A | * | 3/1997 | Kelly et al. | 148/671 |
| 5,634,992 A | | 6/1997 | Kelly et al. | |
| 5,653,828 A | | 8/1997 | Zhao et al. | |
| 5,768,679 A | * | 6/1998 | Taguchi et al. | 428/548 |
| 5,823,243 A | * | 10/1998 | Kelly | 164/57.1 |
| 5,997,808 A | * | 12/1999 | Jones et al. | 420/418 |
| 6,161,285 A | | 12/2000 | Eberhardt et al. | |
| 6,231,699 B1 | * | 5/2001 | Kelly et al. | 148/670 |

FOREIGN PATENT DOCUMENTS

| | | |
|---|---|---|
| DE | 41 40 707 A1 | 6/1992 |
| EP | 0 634 496 A1 | 1/1995 |
| EP | 0 965 412 B1 | 12/1999 |

OTHER PUBLICATIONS

Semiatin, S. L. et al.: "Processing of Intermetallic Alloys", Edited by Nathal, M. V. et al., Structural Intermetallics, The Minerals, Metals & Materials Society, Sep. 21, 1997, pp. 263–276.

Kim, Y.–W.: "Intermetallic Alloys Based on Gamma Titanium Aluminide", JOM, Jul. 1989, pp. 24–30.

Kim, Y.–W.: "Ordered Intermetallic Alloys, Part III: Gamma Titanium Aluminides", JOM, Jul. 1994, pp. 30–39.

Müller–Späth, H.: "Legierungsentwicklung unter Einsatz des SSP–Verfahrens und Umsetzung intelligenter Materialkonzepte beim Thixogieβen" [Alloy Development with Use of the SSP–Method and Conversation of Intelligent Material Concepts During Thixotrop Casting], Shaker Verlag, vol. 7, 1999, 7 cover pages and pp. I–XXIV.

* cited by examiner

*Primary Examiner*—Deborah Jones
*Assistant Examiner*—Jason L Savage
(74) *Attorney, Agent, or Firm*—Laurence A. Greenberg; Werner H. Stemer; Ralph E. Locher

(57) ABSTRACT

A shaped part or article of manufacture is formed of a selected gamma titanium aluminide alloy with outstanding mechanical properties which can be produced particularly economically. First, a semi-finished article is formed in a hot forming process with a degree of deformation of greater than 65%. Then the semi-finished article is shaped with the alloy being in a solid-liquid phase by applying mechanical forming forces during at least part of the shaping process.

28 Claims, No Drawings

SHAPED PART MADE OF AN INTERMETALLIC GAMMA TITANIUM ALUMINIDE MATERIAL, AND PRODUCTION METHOD

CROSS-REFERENCE TO RELATED APPLICATION

This application is a continuation of copending International Application No. PCT/AT02/00205, filed Jul. 12, 2002, which designated the United States and which was not published in English.

BACKGROUND OF THE INVENTION

Field of the Invention

The invention relates to a shaped part consisting of an intermetallic gamma TiAl material (γ-TiAl, gamma titanium aluminide alloy) with 41–49 atom % Al. The invention also relates to a process for producing the part.

Gamma TiAl materials are frequently referred to as "near-gamma-titanium aluminides". The metal structure in these materials consists primarily of a TiAl phase (gamma phase) and a small proportion of a $Ti_3Al$ ($\alpha_2$ phase). In some multi-component alloys, a small proportion of a beta phase may also be present. This phase is stabilized by such elements as chromium, tungsten, or molybdenum.

According to J. W. Kim (*J. Met.* 41 (7), pp. 24–30, 1989, *J. Met.* 46 (7), pp. 30–39, 1994), individual groups of advantageous alloy elements in gamma TiAl alloys can be described as follows (in atom %):

Ti—$Al_{45-48}$—$(Cr, Mn, V)_{0-3}$—$(Nb, Ta, Mo, W)_{0-5}$—$(Si, B)_{0-1}$. Niobium, tungsten, molybdenum and, to a lesser degree, tantalum improve oxidation resistance, while chromium, manganese and vanadium have a ductilizing effect.

Due to their high strength/density ratio, their high specific Young's Modulus, their oxidation resistance, and their creep resistance, intermetallic gamma TiAl materials present interesting possibilities for a wide range of different applications. These include, for example, turbine components and automotive engine or transmission parts.

The prerequisite for the use of gamma TiAl on an industrial scale is the availability of a technically reliable forming process which facilitates the cost-effective production of shaped parts with properties that meet the specific requirements of a given application.

Based on experience with the processing of titanium in casting operations, considerable effort has been made in recent years to develop a fine casting process for gamma TiAl materials.

It has been demonstrated that the coarse casting structure ordinarily achieved is highly disadvantageous with regard to the mechanical properties of gamma TiAl. Molded parts made of intermetallic gamma TiAl materials based on Ti—45 atom % Al—5 atom % Nb, produced using fine casting methods, exhibit an unacceptable coarse structure with a mean grain size of >500 μm, whereby minimum and maximum grain sizes are distributed over a very broad range.

A molded part produced using fine casting methods with an alloy composition of 44 atom % Al—1 atom % V—5 atom % Nb—1 atom % B, remainder Ti (an alloy in conformity with European patent publication EP 0 634 496 and U.S. Pat. No. 5,514,333) exhibits a mean grain size in the range of 550 μm and also has a broad grain-size range.

The following attempts to achieve a fine grain structure using different alloy compositions and production processes are described as representative of the many such experiments conducted in recent years.

U.S. Pat. No. 5,429,796 describes a cast article made of a titanium aluminide material consisting of 44–52 atom % aluminum, 0.05–8 atom % of one or more elements from the group chromium, carbon, gallium, molybdenum, manganese, niobium, silicon, tantalum, vanadium and tungsten and at least 0.5 vol. % of boride dispersoids with a yield strength of 55 ksi and a ductility of at least 0.5%. The achievable mean grain sizes in the preferred alloys produced using the processes cited in the patent, Ti—47.7 atom % Al—2 atom % Nb—2 atom % Mn—1 vol. % $TiB_2$ Ti—44.2 atom % Al—2 atom % Nb—1.4 atom % Mn—2 vol. % $TiB_2$ and Ti—45.4 atom % Al—1.9 atom % Nb—1.6 atom % Mn—4.6 vol. %, $TiB_2$, ranged between 50 and 150 μm, i.e. the structure was relatively fine. With an alloy composition of Ti—45.4 atom % Al—1.9 atom % Nb—1.4 atom % Mn—0.1 vol. %, $TiB_2$, the mean grain size was 1000 μm, i.e. the structure was relatively coarse.

The two alloys with a high proportion of $TiB_2$ dispersoids tend to form coarse boride excretions at the grain boundaries during slow cooling following the casting process. These have a highly disadvantageous effect on the mechanical properties of the article. It is not possible to increase the cooling speed, as this induces thermal tensions which cause cracks to appear. The borides are added to the pre-alloy in a molten state. In order to reduce the unavoidable coarsening of the borides in the melt to the lowest possible level, the time interval between casting and the beginning of the hardening process must be kept short, which presents a further difficulty in the manufacturing process. In addition to these problems affecting the production process, high boride concentrations, which appear to be helpful in achieving effective grain size reduction, have a negative effect on the mechanical characteristics of the alloy.

The use of heat treatment to achieve a fine grain structure in intermetallic gamma TiAl materials is well known; see for example U.S. Pat. Nos. 5,634,992; 5,226,985; 5,204,058; and 5,653,828. With the aid of the heat treatments described in these patents, a degree of fineness is achieved in which the grain size of the cast structure is the most favorable that can be achieved through heat treatment. Ultimately, a degree of fineness that meets all the requirements of users cannot be achieved in a matrix structure produced in a casting process.

In addition to the coarse matrix structure, casting pores and blowholes have a disadvantageous effect on the mechanical properties of cast gamma TiAl articles. Consequently, recompression processes such as hot isostatic pressing or reforming processes must be applied in order to produce technically viable cast articles.

Due to the difficulties described above, the manufacture of shaped parts made of intermetallic gamma titanium aluminides using conventional casting processes such as fine casting has not been realized on an industrial scale.

As an alternative to casting, shaped parts with near-final form, shaped parts with final form and pre-material for further form processing are produced using standard powder-metallurgic processes such as hot isostatic pressing (see, for example, U.S. Pat. Nos. 4,917,858; 5,015,534; and 5,424,027). In those cases, powders produced using standard spray processes are used. Shaped parts produced using powder-metallurgy processes are significantly more fine-grained that those produced by casting. However, material produced using powder-metallurgy processes exhibits gasfilled pores—usually argon gas used in spray powder production. The pores have a negative effect on both creep deformation and fatigue resistance.

A satisfactory degree of grain fineness can be achieved in cast articles made of gamma TiAl with specially developed refining processes such as extrusion, forging, rolling and combinations of these processes. Thus industrial-scale production of gamma TiAl alloys ordinarily involves the use of VAR (vacuum arc remelting) base material which is converted to a fine-grained state through deformation and heat treatment. The actual forming of such products is effected following heat treatment in time-consuming mechanical processing which usually involves machining operations.

The entire manufacturing process for such shaped parts is thus expensive and restricts the range of possible applications due to cost considerations.

SUMMARY OF THE INVENTION

It is accordingly an object of the invention to provide an intermetallic gamma titanium aluminide alloy article, which overcomes the above-mentioned disadvantages of the heretofore-known devices and methods of this general type and which, measured against the current state of the art as described above, provides a fine-grained shaped part that is as pore-free and ductile as possible on the basis of intermetallic gamma TiAl using comparatively economical production technology.

With the foregoing and other objects in view there is provided, in accordance with the invention, a shaped part formed of an intermetallic gamma TiAl alloy with 41–49 atom % Al, which exhibits a grain size of $d_{95}$<300 $\mu$m and a pore volume of <0.2 vol. %. The manufacture of the article comprises at least the following processing steps:

producing a semi-finished article involving a deformation process, with a degree of deformation greater than >65%;

shaping the semi-finished product in a solid-liquid phase state of the alloy in a mold applying mechanical forming forces during at least part of the process.

The processing of an alloy in the solid-liquid phase state is a semi-solid process. In semi-solid processes, ordinarily semi-liquid masses are processed in a thixotropic state, thixotropy is the state in which a material is highly viscous in the absence of external forces but assumes much lower viscosity under the influence of shearing forces. Thixotropic behavior is exhibited only by certain alloy compositions and within temperature ranges in which both solid and liquid phase components are present in the alloy. A semi-solid phase is desirable, in which regular, i.e. globular grains are present in the solid phase component and are surrounded by melt.

The processes used to form alloys using a semi-solid process are well known.

As a rule, molten liquid alloys are slowly cooled to a temperature within the dual-phase solid-liquid range using familiar stirring techniques such as MHD (magnetohydrodynamic stirring) or mechanical stirring in this process. Stirring destroys the dendrites which separate from the melt. It gives the material maximum thixotropic properties and promotes the formation of globular primary crystals in the solid phase.

This process is described for intermetallic materials in U.S. Pat. No. 5,358,687, where TiAl is cited among other materials, although, in contrast to the present invention, no mention is made of subsequent forming processes using mechanical heat reforming steps. The achievable grain size was >50 $\mu$m.

The application of this process to gamma TiAl does not permit economical manufacture, as mechanical wear of the stirrer is too high.

In previous years, semi-finished products consisting of individual steel alloys were produced with extruders on a laboratory scale with structures that exhibited thixotropic properties during subsequent processing in the dual-phase solid-liquid range (dissertation by H. Müller-Späth, RWTH Aachen, 1999). However, no encouraging improvements in quality or cost-effectiveness have been achieved in this way.

Unlike steel alloys, intermetallic materials are difficult to handle in deformation processes. The degree of microstructure consolidation achievable in gamma TiAl, in particular, is less than satisfactory. This is reflected in the fact that the deformed and dynamically recrystallized matrix regularly exhibits a banded structure and chemical inhomogeneities resulting from segregation.

Those of skill in the art could not have foreseen that, according to the invention, gamma TiAl alloys reformed into semi-finished products in an initial heat-reforming process would exhibit thixotropic behavior after being heated to a temperature within the solid-liquid range for further shaping processing. Yet the prerequisite is a degree of deformation of >65%. The deformation degree is defined as follows:

Degree of deformation={(cross-sectional area prior to deformation−cross-sectional area in the deformed state)/cross-section area prior to deformation}×100 [%].

The level of thixotropic behavior is not satisfactory at low degrees of deformation.

Proof of the advantages described was obtained using a processing sequence that is described in greater detail in the examples for various gamma TiAl alloys.

Gamma TiAl base material produced by VAR (vacuum arc remelting) was deformed via extrusion with a degree of deformation of >65%. The semi-finished product in the form of a roughly shaped billet was then heated inductively to a temperature between solid and liquid. In this state, the semi-finished product exhibited a sufficient degree of "handling" stability that it could be formed using a thixo-casting process. For this purpose, it was placed in the fill chamber of a die casting machine and pressed into the adjacent die by the pressure cylinder. Under the resulting shearing load, the alloy took the form of a viscous suspension that could be used to form complexly designed parts. This process of pressing the material into the die must take place without material flow turbulence in order to ensure that the material expands without forming pores and blowholes within the casting die.

The use of this shaping process made it possible to eliminate or substantially reduce the need for subsequent mechanical machining, which meant that, in addition to the outstanding structural and mechanical properties of the material, the shaped parts according to the invention could be produced very economically. Compared to molded parts cast directly from a molten mass in a final mold, the advantage of parts made according to the invention lies in their significantly more fine-grained matrix structure and a lower incidence of pore formation.

In order to establish a standard for the grain size of the molded parts manufactured in this way, grain size distribution was determined using the intercepted-segment method and the value $d_{95}$. This means that 95% of the grains analyzed exhibited a diameter smaller than the value indicated. It should be noted in this context that the grain size of $d_{95}$ produced a much higher numerical value than would be the case if the value were expressed as the mean grain size.

In matrices with a broad particle-size distribution range, however, $d_{95}$ is a much more reliable value. Depending upon the composition of the gamma TiAl material and the semi-solid process used, the achievable $d_{95}$ grain sizes lie with a range of <100 μm to <300 μm.

Molded parts produced for purposes of comparison by fine casting and not further processed through heat-reforming exhibit a matrix with five times the grain size of shaped parts produced in accordance with the invention.

The difference in grain size is especially marked when, in accordance with the preferred embodiment of the invention, alloys with a niobium content of between 1.5 and 12 atom % are used. These alloys exhibit structures that are from 7 to 16 times as fine-grained as those achieved through conventional manufacture using fine casting.

The best results were achieved with gamma TiAl alloys consisting of between 5 and 10 atom % of niobium. An additional degree of fineness was achieved by adding carbon and boron to the alloy in concentrations of up to 0.4 atom %.

Acceptable alternative forming processes for gamma TiAl alloys in accordance with the invention in the solid-liquid phase include thixo-forging and thixo-lateral extrusion, each of which is a familiar, tested process. In thixo-forging, the semi-liquid billet is laid in an open tool or die. The part is formed by a subsequent tool operation, in a forging press, for example.

The thixo-lateral extrusion process is a modified form of thixo-casting. Here, a plug driven by a punch is diverted at a 90° angle on its way from the casting chamber to the die or the forming tool.

The invention is described in greater detail with reference to examples of production sequences:

EXAMPLE 1

A primary melt of an alloy composed of titanium—46.5 atom % Al—2 atom % Cr—1.5 atom % Nb—0.5 atom % Ta—0.1 atom % boron was produced using VAR (vacuum arc remelting). In order to achieve a satisfactory degree of homogeneity, the casting block was remelted twice. The ingot measured 210 mm in diameter and 420 mm in length.

The canned ingot was extruded under the previously identified production conditions. The degree of deformation was 83%. A billet segment measuring 110 mm in length was then heated to a temperature within the solid-liquid range of the alloy (1460–1470° C.) and then extruded in this state in a servo-hydraulic press through a closed die casting tool made of a molybdenum alloy.

The molded part produced in this way, a cylindrical component with a mean diameter of 40 mm, a length of 100 mm, a flange mounted on one side and a cavity measuring 35 mm×35 mm×35 mm in the cylindrical section was subjected to metallographic testing. The $d_{95}$ grain size was 120 μm.

The relative density was determined using the buoyancy method to be 99.98%. By way of comparison, the $d_{95}$ grain size of the twice-remelted fine casting part was 1400 μm.

EXAMPLE 2

Analogous to the process sequence described in Example 1, an alloy ingot composed of titanium—45 atom % Al—5 atom % Nb—0.2 atom % C—0.2 atom % boron was produced by vacuum arc remelting (VAR) and remelted twice. The ingot measured 210 mm in diameter and 420 mm in length.

The canned ingot was extruded using a standard process. The degree of deformation was 83%. A billet segment measuring 110 mm in length was heated to a temperature of between 1460 and 1480° C., thus transforming the alloy into the solid-liquid phase range. In this state, it was extruded in a servo-hydraulic press through a closed die casting tool made of a molybdenum alloy.

The molded part produced in this way, a cylindrical component with a mean diameter of 40 mm, a length of 100 mm, a flange mounted on one side and a cavity measuring 35 mm×35 mm×35 mm in the cylindrical section was subjected to metallurgical testing.

The $d_{95}$ grain size was 75 μm.

Relative density was 99.99%.

The $d_{95}$ grain size of the initially produced precision casting part was 1200 μm.

EXAMPLE 3

Analogous to the process described in Example 1, a primary cast billet consisting of the alloy titanium—46.5 atom % Al—2 atom % Cr—0.5 atom % Ta—0.1 atom % boron was produced using vacuum arc remelting (VAR) and remelted twice. The ingot measured 170 mm in diameter and 420 in length.

The canned ingot was extruded with a degree of deformation of 83%. A billet segment measuring 110 mm in length was heated to a temperature of 1440–1470° C. and pressed in a servo-hydraulic press through a closed die casting tool made of a molybdenum alloy.

The shaped part produced in this way, a part with a mean diameter of 40 mm, a length of 100 mm, a flange on one side and a cavity measuring 35 mm×35 mm×35 mm in the cylindrical segment was subjected to metallographic testing.

The $d_{95}$ grain size was 220 μm.

Relative density was 99.99%.

The $d_{95}$ grain size of the fine-cast part was 1500 μm.

EXAMPLE 4

A primary casting block consisting of the alloy titanium—46.5 atom % Al—10 atom % Nb was produced using the process steps described in Example 1 via vacuum arc remelting (VAR) and remelted twice. The ingot measured 170 mm in diameter and 420 mm in length.

The canned ingot was extruded with a degree of deformation of 83%. A billet segment measuring 110 mm in length was heated to a temperature of 1440–1470° C. and pressed in a servo-hydraulic press through a closed die casting tool made of a molybdenum alloy.

The shaped part produced in this was, a cylindrical part with a mean diameter of 40 mm, a length of 100 mm, a flange on one side and a cavity measuring 35 mm×35 mm×35 mm in the cylindrical segment was subjected to metallographic testing.

The $d_{95}$ grain size was 90 μm.

Relative density was 99.98%.

The $d_{95}$ grain size of the fine-cast part was 1300 μm.

EXAMPLE 5

The primary casting block consisting of the alloy titanium—46.5 atom % Al—10 atom % Nb was produced using the process described in Example 1 by vacuum arc remelting (VAR) and remelted twice. The ingot measured 170 mm in diameter and 420 mm in length.

The canned ingot was extruded with a degree of deformation of 72%. A billet segment with a length of 110 mm was heated to a temperature of 1440–1470° C. and pressed in a servo-hydraulic press into a closed die casting tool made of an molybdenum alloy.

The shaped part produced in this way, a cylindrical part with a mean diameter of 40 mm, a length of 100 mm, a flange on one side and a cavity measuring 35 mm×35 mm×35 mm in the cylindrical segment was subjected to metallographic testing.

The $d_{95}$ grain size was 170 $\mu$m.

The relative density was 99.98%.

The $d_{95}$ grain size of the fine-cast part was 1300 $\mu$m.

It will be understood that the above embodiments are but exemplary implementations of the novel concept and that the invention is not restricted to the embodiments described in the above examples.

Preferred applications for shaped parts produced in accordance with the present invention include, for example, automotive transmission and motor components as well as parts for stationary gas turbines and parts used in aviation and space flight, e.g. turbine components.

We claim:

1. A method of producing a shaped part of intermetallic gamma titanium aluminide alloy composed of 41–49 atom % Al with a grain size $d_{95}$<300 $\mu$m and a pore volume of <0.2 vol. %, the method which comprises the following method steps:

producing a semi-finished article with a hot forming process having a degree of deformation >65%; and shaping the semi-finished article in a solid-liquid phase of the alloy in a mold by applying mechanical forming forces during at least part of the shaping process.

2. The method according to claim 1, which comprises shaping the gamma TiAl alloy in a thixotropic state.

3. The method according to claim 1, which comprises shaping the alloy with solid components in the solid-liquid phase having a globular structure.

4. The method according to claim 1, which comprises shaping the semi-finished article using thixo-forging in a die mold.

5. The method according to claim 1, which comprises shaping the semi-finished article using thixo-extrusion into a die.

6. The method according to claim 1, which comprises processing the semi-finished article using an extrusion process.

7. The method according to claim 1, which comprises forming the shaped part with a grain size $d_{95}$ of <200 $\mu$m.

8. The method according to claim 1, which comprises forming the shaped part with a grain size $d_{95}$ of <150 $\mu$m.

9. The method according to claim 1, wherein the alloy contains 43–47 atom % Al and 1.5–12 atom % niobium.

10. The method according to claim 9, wherein the alloy has a niobium content of 5–10 atom %.

11. The method according to claim 9, wherein the alloy further comprises:

| | |
|---|---|
| 0.05–0.5 | atom % boron; |
| 0–0.5 | atom % carbon; |
| 0–3 | atom % chromium; and |
| 0–2 | atom % tantalum. |

12. The method according to claim 11, wherein the alloy contains 0.1–0.4 atom % carbon and 0.1–0.4 atom % boron.

13. The method according to claim 9, wherein the alloy further comprises 0.05–0.5 atom % boron; a content of up to 0.5 atom % carbon; a content of up to 3 atom % chromium; and a content of up to 2 atom % tantalum.

14. The method according to claim 1, which comprises performing the hot forming process with a degree of deformation of >80%.

15. The method according to claim 1, which comprises shaping the intermetallic gamma titanium aluminum alloy into a component for an automotive transmission or an automotive engine.

16. The method according to claim 1, which comprises shaping the intermetallic gamma titanium aluminum alloy into a component for a stationary or non-stationary gas turbines.

17. A shaped part, comprising an intermetallic gamma titanium aluminide alloy composed of 41–49 atom % Al with a grain size $d_{95}$<300 $\mu$m and a pore volume of <0.2 vol. % produced according to the method of claim 1.

18. A shaped part, comprising:

an intermetallic gamma titanium aluminide alloy composed of 41-49 atom % Al with a grain size $d_{95}$<300 $\mu$m and a pore volume of <0.2 vol. %;

preshaped into a semi-finished article using a hot forming process with a degree of deformation of greater than 65%; and molded into a finished shape from a solid-liquid phase of said alloy by at least partial application of mechanical forming forces.

19. The shaped part according to claim 18, wherein the solid-liquid phase has a solid component with a globular structure.

20. The shaped part according to claim 18, wherein said intermetallic gamma TiAl alloy has a grain size $d_{95}$ of <200 $\mu$m.

21. The shaped part according to claim 20, wherein said alloy has a grain size $d_{95}$ of <150 $\mu$m.

22. The shaped part according to claim 20, wherein said alloy contains 43–47 atom % Al and 1.5–12 atom % niobium.

23. The shaped part according to claim 22, wherein said alloy contains 5–10 atom % niobium.

24. The shaped part according to claim 22, wherein said alloy further comprises:

| | |
|---|---|
| 0.05–0.5 | atom % boron; |
| 0–0.5 | atom % carbon; |
| 0–3 | atom % chromium; and |
| 0–2 | atom % tantalum. |

25. The shaped part according to claim 24, wherein said alloy contains 0.1–0.4 atom % carbon and 0.1–0.4 atom % boron.

26. The shaped part according to claim 22, wherein said alloy further comprises 0.05–0.5 atom % boron; a content of up to 0.5 atom % carbon; a content of up to 3 atom % chromium; and a content of up to 2 atom % tantalum.

27. The shaped part according to claims 18 formed into an automotive transmission or engine component of intermetallic gamma titanium aluminide alloy.

28. The shaped part according to claims 18 formed into a component for a stationary or non-stationary gas turbine.

* * * * *